United States Patent [19]

Wippern

[11] 4,307,526

[45] Dec. 29, 1981

[54] LABEL STRIP WITH SELF-ADHESIVE LABELS

[75] Inventor: Gerhard Wippern, Hirschhorn, Fed. Rep. of Germany

[73] Assignee: Esselte Pendaflex Corp., Garden City, N.Y.

[21] Appl. No.: 64,497

[22] Filed: Aug. 7, 1979

[30] Foreign Application Priority Data Aug. 7, 1978 [DE] Fed Rep of Germany 2834592

[51] Int. Cl.[3] ..... A44C 3/00

[52] U.S. Cl. ..... 40/2 R; 428/42

[58] Field of Search ..... 40/2 R, 359, 360, 594; 428/40, 41, 42, 43

[56] References Cited

U.S. PATENT DOCUMENTS

| | | | |
|---|---|---|---|
| 2,095,437 | 12/1937 | Fox | 40/2 R |
| 2,502,749 | 4/1950 | Reid | 428/43 |
| 2,648,924 | 8/1953 | Brewster | 40/2 R |
| 2,679,928 | 6/1954 | Bishop, Jr. et al. | 428/41 |
| 2,783,172 | 2/1957 | Avery | 40/2 R |
| 2,991,550 | 7/1961 | Block | 427/79 |
| 3,166,186 | 1/1965 | Karn | 428/42 |
| 3,226,862 | 1/1966 | Gabruk | 40/2 R X |
| 3,411,978 | 11/1968 | Frohbach et al. | 428/42 |
| 3,494,056 | 2/1970 | Elzer | 40/2 R |
| 3,764,447 | 10/1973 | Duff | 40/2 R X |
| 3,822,492 | 7/1974 | Crawley | 40/2 R |
| 4,048,736 | 9/1977 | Castleman et al. | 40/2 R |
| 4,182,789 | 1/1980 | Castelluzzo | 428/40 |

FOREIGN PATENT DOCUMENTS

| | | | |
|---|---|---|---|
| 1263474 | 3/1968 | Fed. Rep. of Germany | 428/42 |
| 1289614 | 2/1962 | France | 428/42 |
| 590156 | 10/1957 | Italy | 428/41 |

*Primary Examiner*—Gene Mancene
*Assistant Examiner*—G. Lee Skillington
*Attorney, Agent, or Firm*—Gerald J. Ferguson, Jr.; Joseph J. Baker

[57] ABSTRACT

A label strip with easily removable self-adhesive labels adhering in series to one side of a carrier strip for use in label printing and dispensing apparatuses which are equipped with a pull-off device gradually feeding the labels, the improvement wherein the carrier strip is continuous with respect to the length and width thereof, the carrier strip covering at least the greater part of the self-adhesive layer on the labels and a continuous backing strip disposed adjacent the side of the carrier strip opposite the one side thereof in a plane separate from and parallel to the carrier strip, the backing strip being bonded with the combination of the carrier strip and the self-adhesive labels.

15 Claims, 8 Drawing Figures

LABEL STRIP WITH SELF-ADHESIVE LABELS

Figure 1:
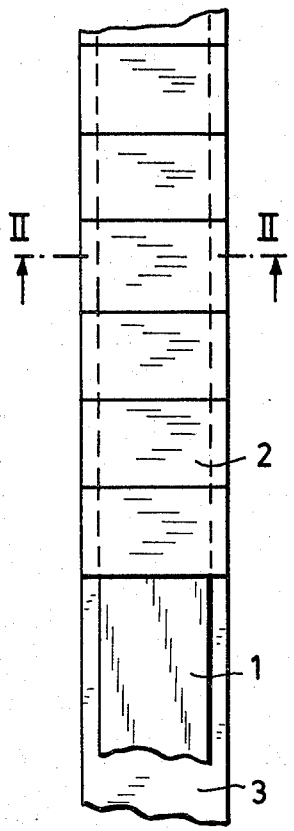

The invention refers to a label strip with self-adhesive labels adhering to a carrier strip in series for use in label printing and dispensing apparatuses, which are equipped with a pull-off device intermittently advancing the labels.

Such labels strips are known from the U.S. Pat. No. 2,095,437 and German Auslegeschrift Nos. 1,205,888 and 1,486,149. These label strips are processed in price-marking apparatuses wherein the labels are printed and then brought into a dispensing position in which they are at least largely released from the carrier strip and can be pressed by a pressure member, for example an elastic roller, against an article to be labelled.

With the help of the label printing and dispensing apparatuses it is also possible to dispense a chain of printed labels inasmuch as label strips are used, whereby the labels are separated merely by a simple separation cut or even by a perforation. If such label strips are, for example, inserted into a manually operated marking apparatus according to German Auslegeschrift No. 1,224,661 and the manually operated labelling apparatus is used only as a label printer, then a chain of contiguous printed self-adhesive labels released from the carrier strip will be dispensed from the apparatus. The self-adhesive labels adhere to one another by means of a glue bridge or a perforation and can be easily separated from one another. The printed labels can then be applied by hand to an article to be labelled.

In this way it is possible to apply labels effortlessly to such surfaces which are unattainable or only attainable with difficulty by the pressure member of the labelling apparatus. Using this method, however, there is the disadvantage that the self-adhesive layer of the printed labels is no longer protected by the carrier strip. For this reason only relatively few labels can be printed in succession and adhered by hand to the surfaces to be labelled, because otherwise there is a risk that the printed self-adhesive labels will stick together or the self-adhesive layer thereof will come into contact with surfaces to which they are not intended to adhere. Also it is difficult to store such self-adhesive labels once freed from the carrier strip.

The task of the invention is to create a label strip of the initially named type, whereby the disadvantages portrayed do not occur and the printed labels can either be pressed by the pressure member of the labelling apparatus on an article to be labelled or a series of printed labels can be dispensed, the self-adhesive layer whereof being at least largely protected.

This problem is solved according to the invention by arranging a continuous backing strip which is bonded easily removable with relatively slight adhesive force to the carrier strip or the self-adhesive labels. If such a label strip is inserted in a price-marking apparatus then the label feed can be effected by either pulling off gradually only the backing strip using the pull-off device of the labelling apparatus or by pulling off progressively the backing strip together with the carrier strip by means of the pull-off device. In the first case the carrier strip is freed at the deflection guide device of the price-marking apparatus together with the thereto adhered self-adhesive labels from the backing strip. Thereby a band is obtained which is made up of a carrier strip and the thereto adhered printed labels.

Such a band of printed labels can serve various purposes. It is for example possible when marking articles not easily accessible using the price-marking apparatus such as for example textiles on a shelf or in a cupboard, stacks of washing, towels, bedlinen or those articles whereby a label brought into the dispensing position on the price-marking apparatus can only be pressed on with difficulty using the pressure roller, for example in the case of extremely small articles such as jewellery, small toys, glass and china animal figures or for adhering prices on tie-on labels, to use several people, each provided with a band of printed labels, who remove the self-adhesive labels from this band by hand and then press them onto the article for labelling.

Another possible use for such label strips is to supply sales assistants with strips of self-adhesive labels whereon is printed a symbol identifying the sales assistant. Upon sale of an article the sales assistant can apply the self-adhesive label identifying him or herself alongside the price label, so that for example at the cash desk not only the sale of the article but also the sales assistant is registered, in order to record the sales success of the individual sales assistants.

If the label strip according to the invention is inserted into a price-marking apparatus such that the pull-off device pulls off the backing strip as well as the carrier strip, then with the help of the labelling apparatus the labels can be printed and the printed label once brought respectively into dispensing position can be pressed by means of the pressure member against an article to be labelled. In order to reset the price-marking apparatus the carrier strip need only be guided around the deflection edge and be placed together with the backing strip into the pull-off device, for example a pair of rollers.

Expediently an adhesive agent is arranged between the carrier strip and the backing strip in order to achieve in this way a certain adherence of the carrier strip to the backing strip. It can be advantageous to use a wax type adhesive or respectively an adhesive which is non self-adhesive or only very slightly self-adhesive.

The carrier strip can however also be bonded with the backing strip by means of an embossing.

To achieve a bond of the backing strip with the remaining label strip it can also be advantageous to make the carrier strip somewhat narrower than the backing strip and the self-adhesive labels. In the case of such a label strip the margins of the self-adhesive labels adhere to the backing strip. A label strip of this type has the advantage that in the case of a strip of printed labels these labels can be very easily removed.

Depending on the type and design of the pull-off device of the labelling apparatus care must be taken that the backing strip passes through the feed device of the labelling apparatus free of adhesive. One must prevent adhesive particles from settling on the feed device of the labelling apparatus and thereby causing malfunctions. In the case of the known labelling apparatuses the devices for pulling off the carrier strip or a backing strip consist of a pair of rollers or a forward and backward-moving gripper or of a pinch roll which is provided with projections which engage into recesses of the carrier strip or of a backing strip.

There are pull-off devices for labelling apparatuses which only come into contact with carrier strip or backing strip to be pulled off over a certain section of the width of the strip. For these apparatuses a label strip is particularly advantageous whereby the carrier strip has on both its sides an adhesive repellent, in particular siliconized layer and the backing strip is provided with a self-adhesive layer at places on the side adjacent to the carrier strip. In the case of this label strip the self-adhesive agent does indeed adhere to the backing strip but nevertheless the self-adhesive agent is successfully applied to the backing strip in such a way that it does not come into contact with the elements of the feed device of the labelling apparatus. The self-adhesive layer can be arranged as a very narrow band in the central area of the backing strip or as two narrow bands in the proximity of the margins of the backing strip, depending on how the transport device of the labelling apparatus is shaped. As the backing strip is only intended to adhere to the carrier strip with slight adhesive strength, the self-adhesive layer can be applied very sparingly, i.e. very thinly and on relatively small surface areas of the backing strip. This labelling strip has the advantage that the carrier strip is completely free of adhesive on its underside, when it leaves the label printing and dispensing apparatus together with the pre-printed labels.

It is however also possible to arrange between the backing strip and the carrier strip a continuous bandlike self-adhesive layer and to provide the carrier strip on both sides and the backing strip on at least the side adjacent to the carrier strip with an adhesive repellent, in particular siliconized layer. In the case of this label strip the self-adhesive layer would have to form a continuous band in order to be able to be fed into the price-marking apparatus at the deflection device together with the carrier strip and then pulled off from the carrier strip.

There now follows a more detailed explanation of four embodiment examples with reference to the drawing.

The FIGS. 1,3,5 and 7 show top views of four embodiment forms of the label strip according to the invention, FIGS. 2,4,6 and 8 show sectional views of the label strips portrayed in FIGS. 1,3,5 and 7, whereby the thickness of the strips is greatly increased.

The label strips consist of a carrier strip 1, self-adhesive labels 2 adhering to the carrier strip and a backing strip 3 arranged under the carrier strip 1.

In FIG. 1 a label strip is shown with smooth lateral margins whereby the width of the rectangular self-adhesive labels 2 corresponds to the width of the backing strip 3, and the labels 2 directly contiguous are separated from one another by smooth separation cuts.

Figure 2:
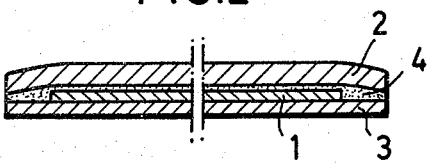

As FIG. 2 shows, the self-adhesive labels 2 adhere with their self-adhesive layer 4 both to the carrier strip 1 as well as to the margins on the backing strip 3. If the self-adhesive labels 2 are only printed with a price-marking apparatus then the carrier strip 1 is released at the deflection guide device of the labelling apparatus with the thereto adhered labels 2 from the backing strip 3. The self-adhesive labels whereof the margins protrude laterally beyond the carrier strip can now be very easily removed from the carrier strip 1. Nevertheless the carrier strip 1 protects the greater part of the self-adhesive layer 4 of the labels 2.

Figure 3:
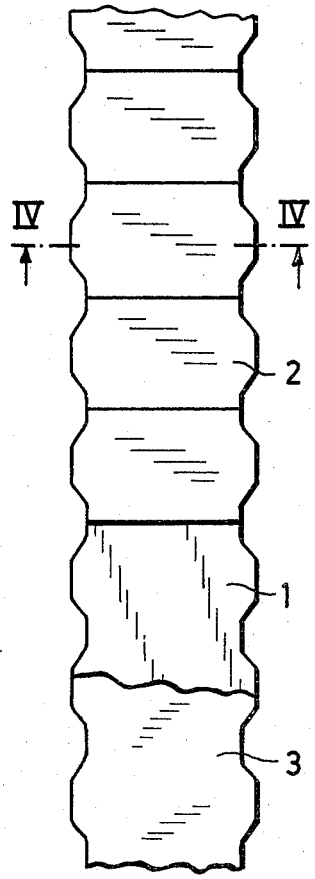
Figure 4:
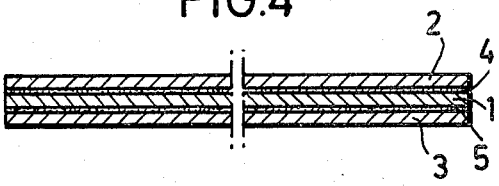

FIG. 3 shows a label strip with undulating lateral margins whereby the carrier strip 1, the backing strip 3 and the band of self-adhesive labels 2 are congruent. As FIG. 4 shows, an adhesive agent 5 is arranged between the carrier strip 1 and the backing strip 3 which produces a slight adhesive bond between the carrier strip 1 and the backing strip 3. Wax or stearin can be used as adhesive agent. The adhesive agent can be applied as a thin layer or in a spot grid.

Figure 5:
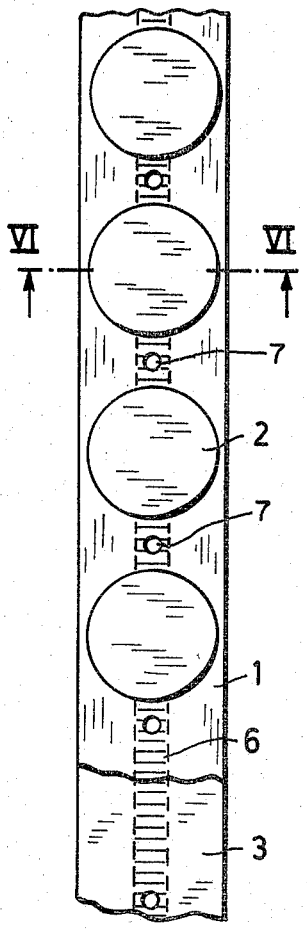

In the case of the embodiment example according to FIG. 5 orbicular labels adhere to the carrier strip 1. The carrier strip 1 is bonded with the identical sized backing strip 3 by means of an embossing 6, which is arranged in the longitudinal centre of the label strip. In the longitudinal centre of the carrier strip 1 and the backing strip 3 punchings are arranged equidistant between the labels 2. Elements of the pull-off device of a price-marking apparatus can engage in these punchings, whereby an exactly indexed feed of the labels is effected. Further, due to the apertures or punchings 7 in the carrier strip 1, the backing strip 3 is connected to the labels 2 via the self-adhesive layer 4 of the labels 2, a portion 8 of the self-adhesive layer 4 being shown in FIG. 6 extending through the aperture.

Figure 7:
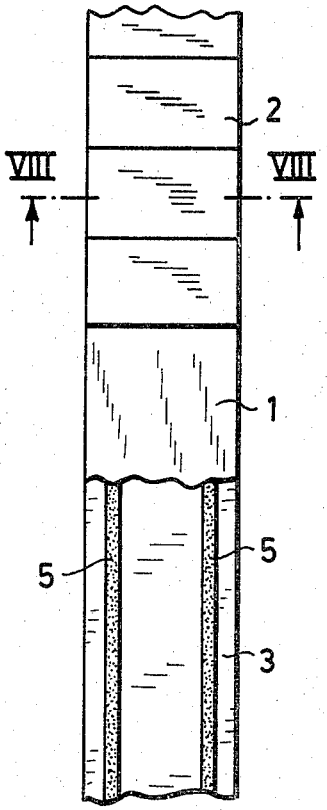
Figure 6:
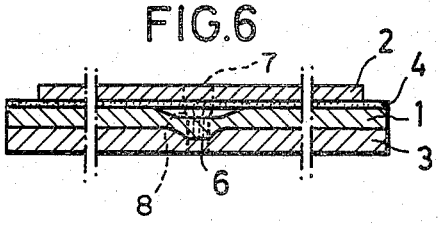
Figure 8:
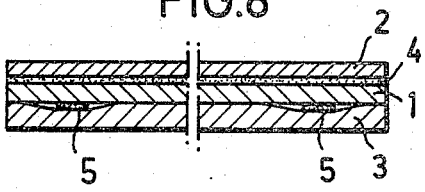

In the case of the label strip according to FIG. 7 and 8 the adhesive agent 5 is to be applied in band form to the backing strip 3 and in such a way that it does not come into contact with the elements of the pull-off device of the labelling apparatus which engage in the backing strip 3. In the case of this label strip the carrier strip 1 is provided on both sides with an adhesive repellent layer.

I claim:

1. A label strip with easily removable self-adhesive labels adhering in series to one side of a carrier strip for use in label printing and dispensing apparatuses which are equipped with a pull-off device gradually feeding the labels, the improvement wherein said carrier strip is continuous with respect to the length and width thereof, the carrier strip covering at least the greater part of the self-adhesive layer on said labels and a continuous backing strip disposed adjacent the side of said carrier strip opposite said one side thereof in a plane separate from and parallel to the carrier strip, said backing strip being bonded with the combination of said carrier strip and the self-adhesive labels.

2. A label strip as in claim 1 where said self-adhesive labels are defined by a series of cuts transverse to the length of the label strip.

3. A label strip according to claim 1 wherein said carrier strip is connected with said backing strip via combined embossings of the carrier strip and the backing strip.

4. A label strip according to claim 1 wherein an adhesive agent is arranged at least in places between said carrier strip and said backing strip.

5. A label strip according to claim 4 wherein said adhesive agent is wax-like.

6. A label strip according to claim 4 wherein said carrier strip has an adhesive repellent on both sides, and said backing strip is provided at least in places with a further self-adhesive layer on the side adjacent to said carrier strip.

7. A label strip according to claim 6 wherein said further self-adhesive layer only extends over a narrow band in the central area of said backing strip.

8. A label strip according to claim 6 wherein said self-adhesive layer only extends over two narrow bands in the proximity of the margins of said backing strip.

9. A label strip according to claim 6 wherein said adhesive repellent is a siliconized layer.

10. A label strip according to claims 1, 4, 3, 6, 7, 8 or 9 wherein the carrier strip covers the entirety of the self-adhesive layer of said labels.

11. A label strip according to claim 10 where said self-adhesive labels, said carrier strip and said backing strip are congruent.

12. A label strip with easily removable self-adhesive labels adhering in series to one side of a carrier strip for use in label printing and dispensing apparatuses which are equipped with a pull-off device gradually feeding the labels, the improvement wherein said carrier strip is continuous with respect to the length and width thereof, the carrier strip covering a part of the self-adhesive layer of said labels less than the entirety thereof and a continuous backing strip disposed adjacent the side of said carrier strip opposite said one side thereof in a plane separate from and parallel to the carrier strip, said backing strip being bonded with the combination of said carrier strip and the self-adhesive labels and covering said carrier strip and the remaining part of the underside of the self-adhesive labels.

13. A label strip according to claim 12 wherein said backing strip is bonded to the combination of the carrier strip and the self-adhesive labels by the self-adhesive on the remaining part of the underside of the labels.

14. A label strip according to claims 12 or 13 wherein said carrier strip is narrower than said backing strip and said self-adhesive labels.

15. A label strip according to claims 12 or 13 wherein apertures are arranged in said carrier strip by means of which said backing strip is connected via the self-adhesive layer of said self-adhesive labels.

* * * * *